US007706555B2

(12) United States Patent
Kawano et al.

(10) Patent No.: US 7,706,555 B2
(45) Date of Patent: Apr. 27, 2010

(54) STEREOPHONIC DEVICE FOR HEADPHONES AND AUDIO SIGNAL PROCESSING PROGRAM

(75) Inventors: Seiji Kawano, Sunnyvale, CA (US); Makoto Yamanaka, Kobe (JP)

(73) Assignee: Sanyo Electric Co., Ltd., Osaka (JP)

( * ) Notice: Subject to any disclaimer, the term of this patent is extended or adjusted under 35 U.S.C. 154(b) by 734 days.

(21) Appl. No.: 10/468,898

(22) PCT Filed: Feb. 25, 2002

(86) PCT No.: PCT/JP02/01679

§ 371 (c)(1),
(2), (4) Date: Mar. 16, 2004

(87) PCT Pub. No.: WO02/069670

PCT Pub. Date: Sep. 6, 2002

(65) Prior Publication Data

US 2005/0089174 A1 Apr. 28, 2005

(30) Foreign Application Priority Data

Feb. 27, 2001 (JP) ..... 2001-051543

(51) Int. Cl.
*H04R 5/02* (2006.01)

(52) U.S. Cl. ..... 381/310; 381/309; 381/63; 381/74

(58) Field of Classification Search ..... 381/310, 381/74, 63, 309, 61, 62, 1, 17–19, 370
See application file for complete search history.

(56) References Cited

U.S. PATENT DOCUMENTS 4,359,605 A 11/1982 Haramoto et al.
5,680,464 A * 10/1997 Iwamatsu ..... 381/18
5,761,315 A * 6/1998 Iida et al. ..... 381/18
5,796,845 A * 8/1998 Serikawa et al. ..... 381/18
5,974,152 A * 10/1999 Fujinami ..... 381/1
6,021,205 A * 2/2000 Yamada et al. ..... 381/310
6,091,894 A * 7/2000 Fujita et al. ..... 703/13

(Continued)

FOREIGN PATENT DOCUMENTS

EP 1 054 576 A1 11/2000

(Continued)

OTHER PUBLICATIONS

International Search Report for PCT/JP02/01679 mailed on Mar. 26, 2002.

(Continued)

*Primary Examiner*—Vivian Chin
*Assistant Examiner*—Jason R Kurr
(74) *Attorney, Agent, or Firm*—McDermott Will & Emery LLP

(57) ABSTRACT

A stereophonic device for headphones to which a monophonic signal or a stereophonic signal is inputted comprises an uncorrelating processing unit for reducing the correlation between two signals obtained by dividing the inputted monophonic signal into two channels or two signals constituting the inputted stereophonic signal, a reflected sound adding processing unit for adding a reflected sound, and a sound image localizing processing unit for controlling the position where a sound image is localized.

2 Claims, 5 Drawing Sheets

U.S. PATENT DOCUMENTS

| | | | | |
|---|---|---|---|---|
| 6,108,430 | A * | 8/2000 | Kurisu | 381/310 |
| 6,175,631 | B1 * | 1/2001 | Davis et al. | 381/17 |
| 6,498,857 | B1 * | 12/2002 | Sibbald | 381/310 |
| 6,714,652 | B1 * | 3/2004 | Davis et al. | 381/17 |
| 6,816,597 | B1 | 11/2004 | Kawano | |
| 6,970,569 | B1 * | 11/2005 | Yamada | 381/310 |
| 7,149,314 | B2 * | 12/2006 | Dahl et al. | 381/63 |
| 2007/0172086 | A1 | 7/2007 | Dickins et al. | |

FOREIGN PATENT DOCUMENTS

| | | | |
|---|---|---|---|
| JP | 56-65600 | | 6/1981 |
| JP | 56-065600 | A1 | 6/1981 |
| JP | 07-203595 | A1 | 8/1995 |
| JP | 11-262098 | A1 | 9/1999 |
| JP | 2000-138998 | A1 | 5/2000 |
| WO | WO 97/25834 | | 7/1997 |
| WO | WO 99/14983 | | 3/1999 |
| WO | WO 99/35886 | | 7/1999 |

OTHER PUBLICATIONS

English Translation of International Preliminary Examination Report for PCT/JP02/01679 mailed on Oct. 2, 2003.

Korean Office Action issued in corresponding Korean Patent Application No. KR 10-2003-7011217, dated Aug. 28, 2006.

* cited by examiner

STEREOPHONIC DEVICE FOR HEADPHONES AND AUDIO SIGNAL PROCESSING PROGRAM

TECHNICAL FIELD

The present invention relates to a stereophonic device for headphones for reproducing a sound field having a natural spreading feeling using the headphones and an audio signal processing program.

BACKGROUND ART

When music is reproduced using normal headphones, a sound image is localized in the head of a listener (in-head localization), so that a sound field having a spreading feeling cannot be reproduced.

An object of the present invention is to provide a stereophonic device for headphones in which a sound field having a spreading feeling can be reproduced and an audio signal processing program.

DISCLOSURE OF INVENTION

In a stereophonic device for headphones to which a monophonic signal or a stereophonic signal is inputted, a first stereophonic device for headphones according to the present invention is characterized by comprising an uncorrelating processing unit for reducing the correlation between two signals obtained by dividing the inputted monophonic signal into two channels or two signals constituting the inputted stereophonic signal; a reflected sound adding processing unit for adding a reflected sound; and a sound image localizing processing unit for controlling the position where a sound image is localized.

A first audio signal processing program according to the present invention is an audio signal processing program used for a stereophonic device for headphones to which a monophonic signal or a stereophonic signal is inputted, characterized in that a computer is caused to perform uncorrelating processing for reducing the correlation between two signals obtained by dividing the inputted monophonic signal into two channels or two signals constituting the inputted stereophonic signal; reflected sound adding processing for adding a reflected sound; and sound image localizing processing for controlling the position where a sound image is localized.

In a stereophonic device for headphones to which front signals for two or more channels and surround signals for two or more channels are inputted, a second stereophonic device for headphones according to the present invention is characterized in that there are provided, with respect to each of the inputted front signal and the inputted surround signal, an uncorrelating processing unit for reducing the correlation between the signals, a reflected sound adding processing unit for adding a reflected sound, and a sound image localizing processing unit for controlling the position where a sound image is localized.

A second audio signal processing program according to the present invention is a sound signal processing program used for a stereophonic device for headphones to which front signals for two or more channels and surround signals for two or more channels are inputted, characterized by comprising a program for causing a computer to subject the inputted front signal to uncorrelating processing for reducing the correlation between the signals, reflected sound adding processing for adding a reflected sound, and sound image localizing processing for controlling the position where a sound image is localized, and a program for causing the computer to subject the inputted surround signal to uncorrelating processing for reducing the correlation between the signals, reflected sound adding processing for adding a reflected sound, and sound image localizing processing for controlling the position where a sound image is localized.

According to the present invention, a stereophonic device for headphones in which a sound field having a spreading feeling can be reproduced and an audio signal processing program.

BEST MODE FOR CARRYING OUT THE INVENTION

Figure 1:
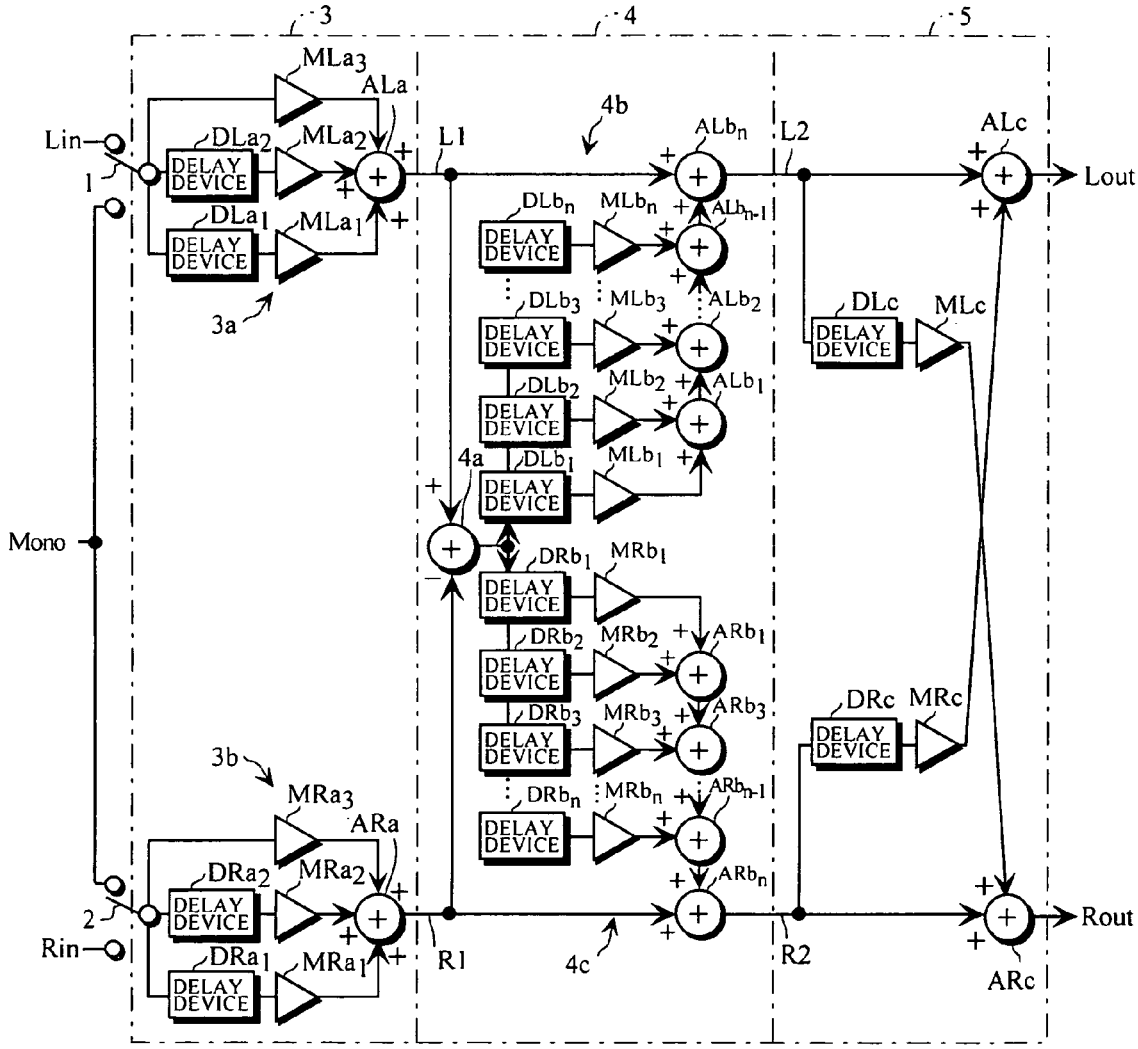
FIG. 1 is a block diagram showing the configuration of a stereophonic device for headphones to which a monophonic signal or a stereophonic signal is inputted.

Referring now to the drawings, an embodiment of the present invention will be described.

[1] Description of First Embodiment

FIG. 1 illustrates the configuration of a stereophonic device for headphones to which a monophonic signal and a stereophonic signal are inputted.

The stereophonic device for headphones comprises two switches 1 and 2 for switching a monophonic signal Mono and a stereophonic signal (a left input signal Lin and a right input signal Rin), an uncorrelating processing unit 3 for subjecting the signal inputted from each of the switches 1 and 2 to uncorrelating processing, a reflected sound adding processing unit 4 provided in the succeeding stage of the uncorrelating processing unit 3, and a sound image localizing processing unit 5 provided in the succeeding stage of the reflected sound adding processing unit 4.

At both the time of inputting the stereophonic signal and the time of inputting the monophonic signal, a left output signal Lout and a right output signal Rout are outputted from the stereophonic device for headphones.

The uncorrelating processing unit 3, the reflected sound adding processing unit 4, and the sound image localizing processing unit 5 will be described.

[2] Description of Uncorrelating Processing Unit 3

The uncorrelating processing unit 3 is for reducing the correlation between two input signals, and has been conventionally used when two pseudo stereophonic signals are generated from one signal which is a morphonic signal.

The uncorrelating processing unit 3 shown in FIG. 1 employs a band division system, and comprises a left signal-uncorrelating processing unit 3*a* provided in the succeeding stage of the switch 1 and a right signal-uncorrelating processing unit 3*b* provided in the succeeding stage of the switch 2.

In the left signal-uncorrelating processing unit 3*a*, the input signal is delayed by a delay device $DLa_1$ and is delayed by a delay device $DLa_2$. A delay time period of the delay device $DLa_1$ and a delay time period of the delay device $DLa_2$ differ from each other.

Multipliers $MLa_1$, $MLa_2$, and $MLa_3$ are respectively provided with respect to the input signal and output signals of the delay devices $DLa_1$ and $DLa_2$. The input signal and the output signals of the delay devices $DLa_1$ and $DLa_2$ are respectively inputted to the corresponding multipliers $MLa_1$, $MLa_2$, and $MLa_3$, and multiplied by coefficients. Output signals of the multipliers $MLa_1$, $MLa_2$, and $MLa_3$ are added together by an adder ALa, and the result of the addition is outputted as a left signal L1.

The configuration of the right signal-uncorrelating processing unit 3*b* is the same as the left signal-uncorrelating processing unit 3*a*, and comprises delay devices $DRa_1$ and $DRa_2$, multipliers $MRa_1$, $MRa_2$, and $MRa_3$, and an adder ARa. The result of the addition by the adder ARa is outputted as a right signal R1.

The left signal-uncorrelating processing unit 3*a* is composed by a first FIR digital filter, and the right signal-uncorrelating processing unit 3*b* is composed by a second FIR digital filter. The filter characteristics of the first FIR digital filter are shown in FIG. 2*a*, and the filter characteristics of the second FIR digital filter are shown in FIG. 2*b*.

Figure 2B:
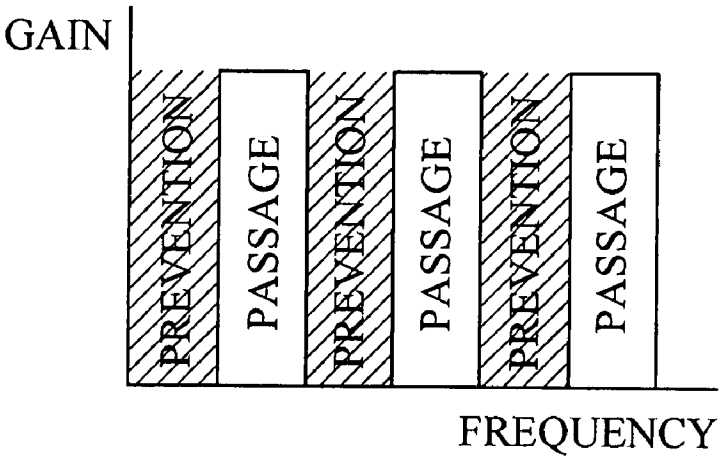
FIGS. 2*a* and 2*b* are schematic views showing the filter characteristics of a first FIR digital filter constituting a left signal-uncorrelating processing unit 3*a* and the filter characteristics of a second FIR digital filter constituting a right signal-uncorrelating processing unit 3*b*.
Figure 2A:
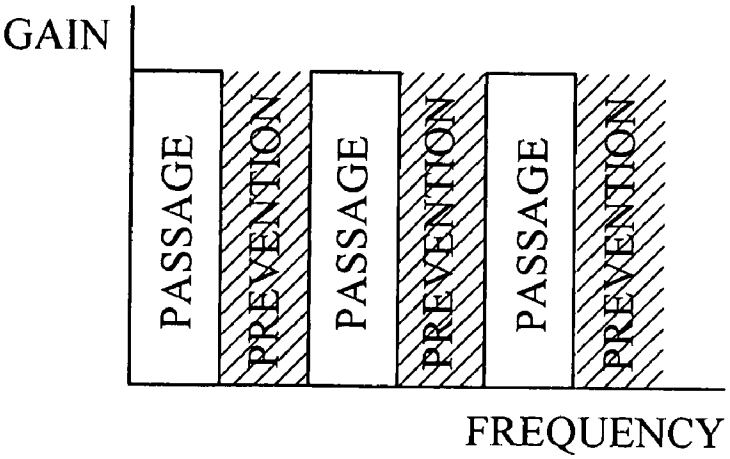

The filter characteristics of each of the FIR digital filters are such characteristics that the frequency band is divided into a plurality of bands, and a passage band and a prevention band alternately appear, as shown in FIGS. 2*a* and 2*b*. The first FIR digital filter and the second FIR digital filter respectively have such characteristics that the passage bands and the prevention bands are opposite to each other such that their filter outputs L1 and R1 are unrelated to each other even if their input signals are the same signal such as a monophonic signal.

[3] Description of Reflected Sound Adding Processing Unit 4

A person perceives a soundscape by a reflected sound or a reverberant sound produced by the ceiling and the wall of a listening place. With headphones in which no reflected sound or reverberant sound in a room is produced, therefore, there is no soundscape. The reflected sound adding processing unit 4 produces a reflected sound or a reverberant sound in a room to give a soundscape to a listener even when the listener listens to music with the headphones.

The reflected sound adding processing unit 4 comprises an adder 4*a* for calculating the difference between the output signal L1 of the left signal-uncorrelating processing unit 3*a* and the output signal R1 of the right signal-uncorrelating processing unit 3*b*, a left signal-reflected sound adding unit 4*b*, and a right signal-reflected sound adding unit 4*c*.

In the left signal-reflected sound adding unit 4*b*, the output signal of the adder 4*a* is delayed by a predetermined time period by each of a plurality of delay devices $DLb_1$ to $DLb_n$ connected in series. Multipliers $MLb_1$ to $MLb_n$ are respectively provided with respect to output signals of the delay devices $DLb_1$ to $DLb_n$. The output signals of the delay devices $DLb_1$ and $DLb_n$ are respectively inputted to the corresponding multipliers $MLb_1$ to $MLb_n$ and multiplied by coefficients. Consequently, a plurality of types of reflected sounds are produced.

The output signals of the multipliers $MLb_1$ to $MLb_n$ are respectively added to the input signal L1 by adders $ALb_1$ to $ALb_n$, and the respective results of the addition are outputted as a left signal L2. Consequently, a plurality of types of reflected sounds are added to the input signal L1.

The configuration of the right signal-uncorrelating processing unit 4*c* is the same as the left signal-uncorrelating processing unit 4*b*, and comprises a plurality of delay devices $DRb_1$ and $DRb_n$, a plurality of multipliers $MRb_1$ to $MRb_n$, and a plurality of adders $ARb_1$ to $ARb_n$. The result of the addition by the adder $ARb_n$ is outputted as a right signal R2.

[4] Description of Sound Image Localizing Processing Unit 5

The sound image localizing processing unit 5 is for controlling the position where a sound image is localized. Before describing the sound image localizing processing unit 5 shown in FIG. 1, a conventional basic sound image localizing processing circuit will be described.

Figure 3:
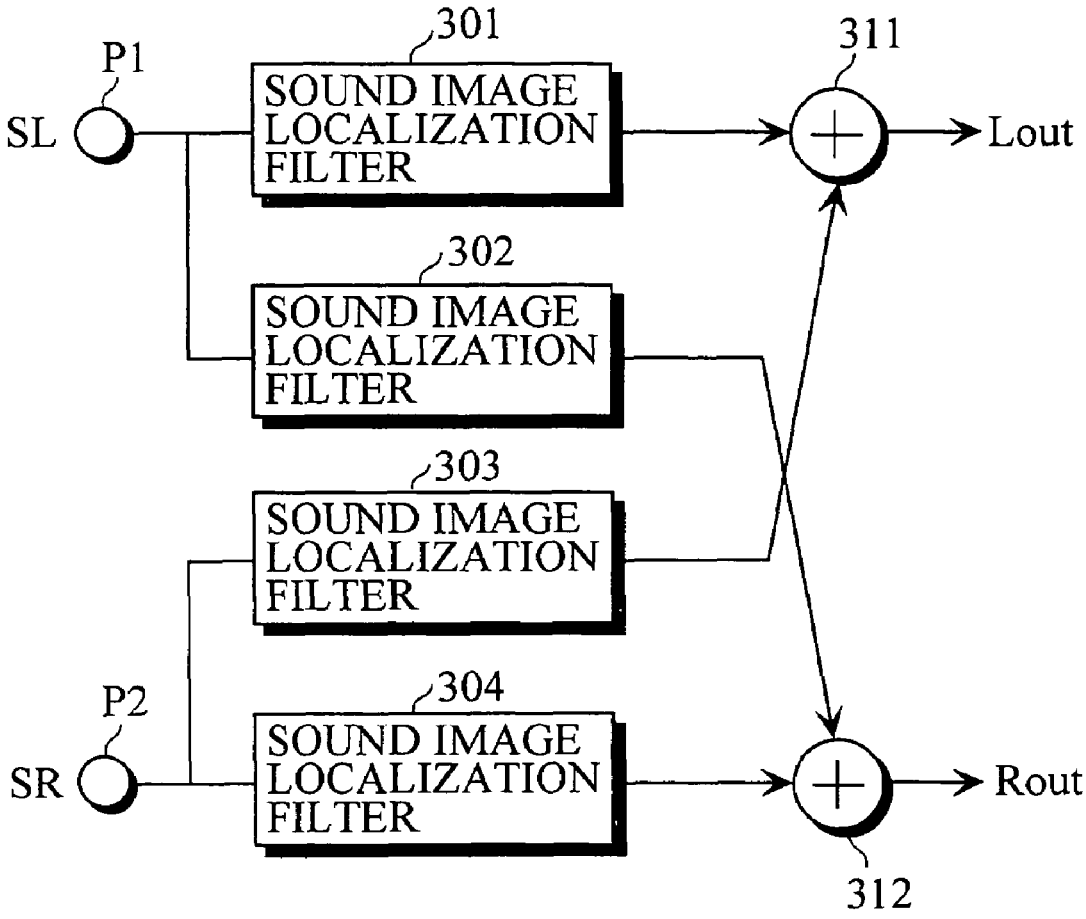
FIG. 3 is a block diagram showing a conventional basic sound image localizing processing circuit.

FIG. 3 illustrates the conventional basic sound image localizing processing circuit.

A left signal inputted to an input terminal P1 is fed to a first sound image localization filter 301 and a second sound image localization filter 302, where filter processing corresponding to a filter coefficient of each of the filters 301 and 302 is performed.

A right signal inputted to an input terminal P2 is fed to a third sound image localization filter 303 and a fourth sound image localization filter 304, where filter processing corresponding to a filter coefficient of each of the filters 303 and 304 is performed. The characteristics of the first sound image localization filter 301 and the characteristics of the fourth sound image localization filter 304 are the same, and the characteristics of the second sound image localization filter 302 and the characteristics of the third sound image localization filter 303 are the same.

An output of the first sound image localization filter 301 and an output of the third sound image localization filter 303 are added together by an adder 311, and the result of the addition is outputted as Lout. An output of the second sound image localization filter 302 and an output of the fourth sound image localization filter 304 are added together by an adder 312, and the result of the addition is outputted as Rout.

Each of the sound image localization filters is found by a head related transfer function, described below. Generally used as each of the sound image localization filters is an FIR (Finite Impulse Response) digital filter having several hundred taps.

Figure 4:
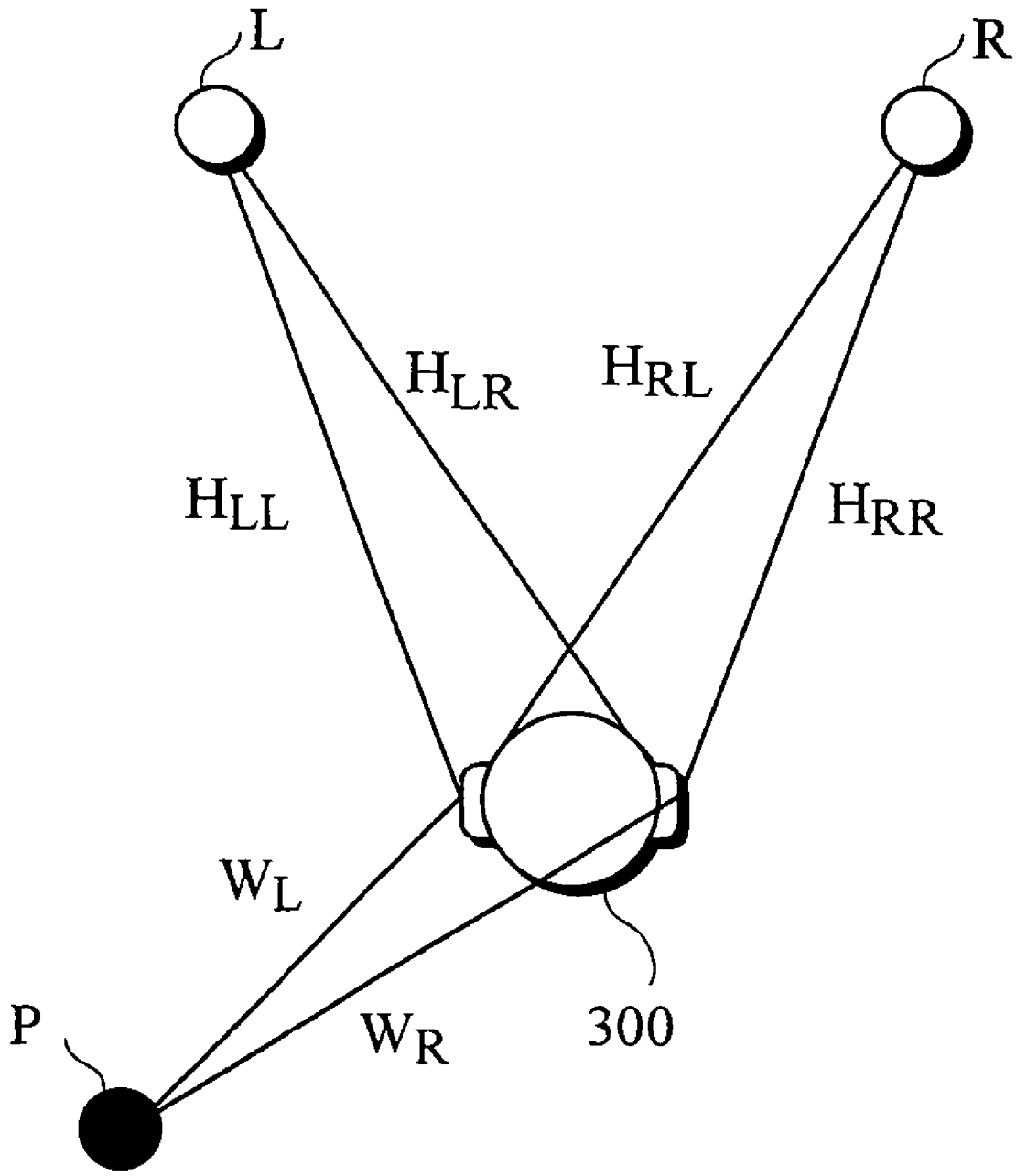
FIG. 4 is a schematic view for explaining a method of calculating the characteristics of a sound image localization filter using a head related transfer function.

Description is now made of a method of calculating the characteristics of the sound image localization filter using the head related transfer function. Let $H_{LL}$, $H_{LR}$, $H_{RL}$, and $H_{RR}$ be respectively transfer functions for transfer paths from real speakers L and R arranged on the right and left sides ahead of a listener 300 to the right and left ears of the listener 300, as shown in FIG. 4. Further, let $W_L$ and $W_R$ be transfer functions from a virtual sound source position P where a sound is desired to be localized to the right and left ears of the listener 300. The transfer functions are all described on the frequency axis.

In order that the listener can listen to an audio as if the audio were outputted from the virtual sound source position P irrespective of the fact that the audio is outputted from the real speakers L and R, the following equation (1) must hold, letting X be an input signal and letting Lout and Rout be respectively output signals from the real speakers L and R:

$$\begin{pmatrix} W_L \\ W_R \end{pmatrix} X = \begin{pmatrix} H_{LL} H_{LR} \\ H_{RL} H_{RR} \end{pmatrix} \begin{pmatrix} L_{out} \\ R_{out} \end{pmatrix} \tag{1}$$

Consequently, the respective signals Lout and Rout outputted from the real speakers L and R are found, as expressed by the following equation (2):

$$\begin{pmatrix} L_{out} \\ R_{out} \end{pmatrix} = \frac{1}{H_{LL} H_{RR} - H_{LR} H_{RL}} \begin{pmatrix} H_{RR} - H_{LR} \\ -H_{RL} H_{LL} \end{pmatrix} \begin{pmatrix} W_L \\ W_R \end{pmatrix} X \tag{2}$$

Furthermore, assuming that the real speakers L and R are set up symmetrically as viewed from the listener, the symmetrical transfer functions are the same, so that the following equations (3) and (4) hold. $H_{THR}$ and $H_{CRS}$ are respectively substituted for the same transfer functions.

$$H_{THR} = H_{LL} = H_{RR} \tag{3}$$

$$H_{CRS} = H_{LR} = H_{RL} \tag{4}$$

Consequently, the foregoing equation (2) can be rewritten, as expressed by the following equation (5):

$$\begin{aligned} \begin{pmatrix} L_{out} \\ R_{out} \end{pmatrix} &= \frac{1}{H_{LL} H_{RR} - H_{LR} H_{RL}} \begin{pmatrix} H_{RR} - H_{LR} \\ -H_{RL} H_{LL} \end{pmatrix} \begin{pmatrix} W_L \\ W_R \end{pmatrix} X \\ &= \frac{1}{H_{THR}^2 - H_{CRS}^2} \begin{pmatrix} H_{THR} - H_{CRS} \\ -H_{CRS} H_{THR} \end{pmatrix} \begin{pmatrix} W_L \\ W_R \end{pmatrix} X \\ &= \begin{pmatrix} \dfrac{H_{THR} W_L - H_{CRS} W_R}{H_{THR}^2 - H_{CRS}^2} \\ \dfrac{H_{THR} W_R - H_{CRS} W_L}{H_{THR}^2 - H_{CRS}^2} \end{pmatrix} X \\ &= \begin{pmatrix} H_1 \\ H_2 \end{pmatrix} X \left( \because \begin{pmatrix} H_1 = \dfrac{H_{THR} W_L - H_{CRS} W_R}{H_{THR}^2 - H_{CRS}^2} \\ H_2 = \dfrac{H_{THR} W_R - H_{CRS} W_L}{H_{THR}^2 - H_{CRS}^2} \end{pmatrix} \right) \end{aligned} \tag{5}$$

Used as a filter obtained by converting $H_1$ and $H_2$ in the foregoing equation (5) into those in a time axis is an FIR digital filter having several hundred taps.

The frequency characteristics of the first sound image localization filter 301 and the fourth sound image localization filter 302 in FIG. 3 correspond to $H_1$ in the foregoing equation (5), and the frequency characteristics of the second sound image localization filter 302 and the third sound image localization filter 303 correspond to $H_2$ in the foregoing equation (5).

Description is made of the sound image localizing processing unit 5 shown in FIG. 1. The sound image localizing processing unit 5 shown in FIG. 1 comprises two delay devices DLc and DRc, two multipliers MLc and MRc, and two adders ALc and ARc.

The left signal L2 inputted from the left signal-reflected sound adding unit 4*b* is fed to the adder ALc, and is fed to a first processing circuit comprising the delay device DLc and the multiplier MLc.

The right signal R2 inputted from the right signal-reflected sound adding unit 4*c* is fed to the adder ARc, and is fed to a second processing circuit comprising the delay device DRc and the multiplier MRc.

In the adder ALc, the left signal L2 and an output signal of the second processing circuit are added together, and the result of the addition is outputted as the left output signal Lout. In the adder ARc, the right signal R2 and an output signal of the first processing circuit are added together, and the result of the addition is outputted as the right output signal Rout.

The sound image localizing processing unit 5 shown in FIG. 1 is one obtained by replacing the first sound image localization filter 301 and the fourth sound image localization filter 304 in the conventional basic sound image localizing processing circuit shown in FIG. 3 with through processing which is one type of filter processing and replacing the second sound image localization filter 302 and the third sound image localization filter 303 in the conventional basic sound image localizing processing circuit with a processing circuit comprising a delay device and a multiplier.

The filter characteristics of the first processing circuit comprising the delay device DLc and the multiplier MLc and the filter characteristics of the second processing circuit comprising the delay device DRc and the multiplier MRc are adjusted, thereby localizing a sound image outside the head. That is, the sound image is prevented from being localized in the head.

[2] Description of Second Embodiment

Figure 5:
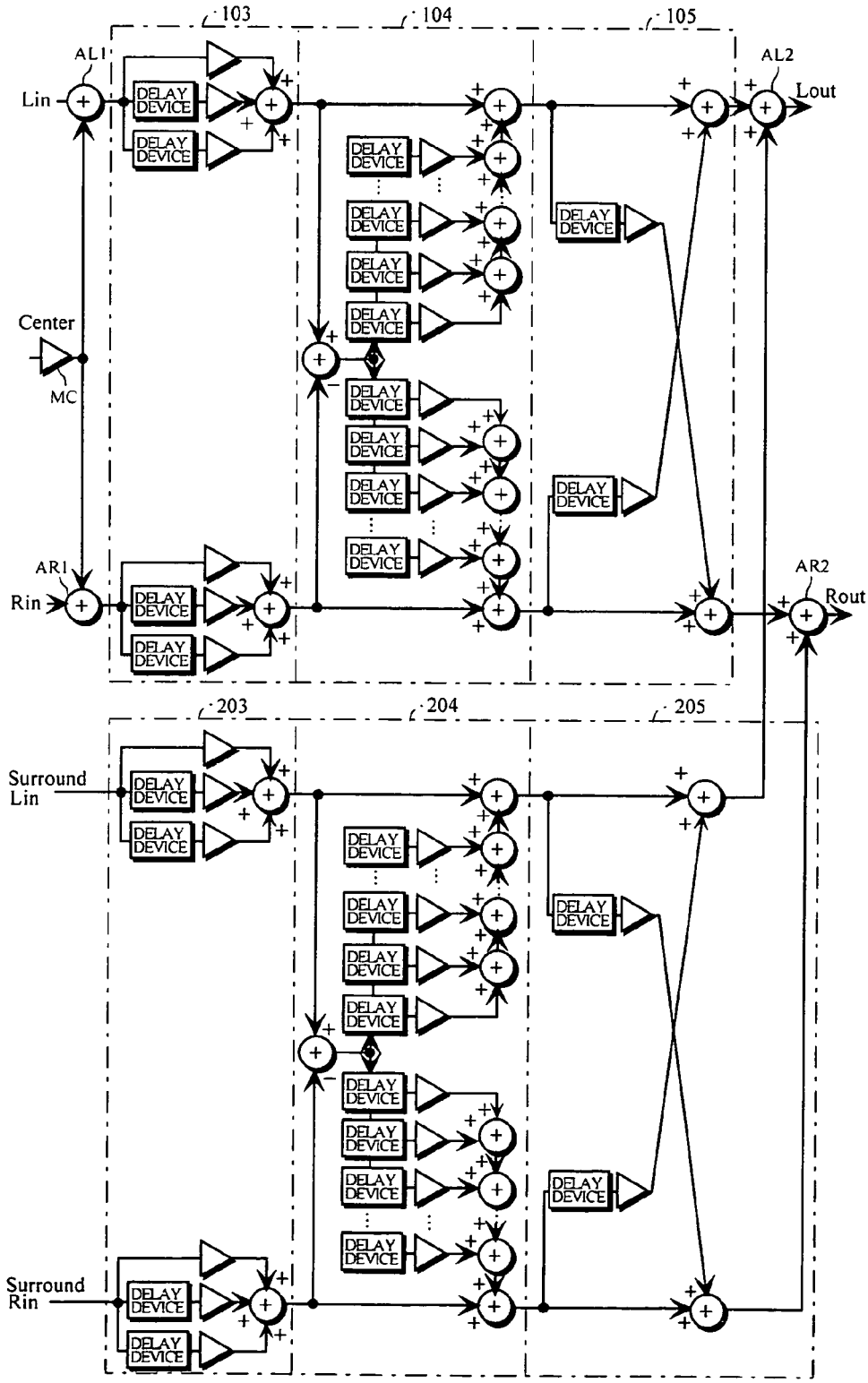
FIG. 5 is an electrical diagram showing the configuration of a stereophonic device for headphones to which front signals for three or more channels and surround signals for two channels are inputted.

FIG. 5 illustrates the configuration of a stereophonic device for headphones to which front signals for three or more channels and surround signals for two channels are inputted.

A multiplier MC multiplies a center input signal Center by a coefficient. An adder AL1 adds an output signal of the multiplier MC to a front left input signal Lin. An adder AR1 adds an output signal of the multiplier MC to a front right input signal Rin.

An uncorrelating processing unit 103, a reflected sound adding processing unit 104, and a sound image localizing processing unit 105, which are the same as those shown in FIG. 1, are provided with respect to a front left signal obtained by the adder AL1 and a front right signal obtained by the adder AR1.

Furthermore, an uncorrelating processing unit 203, a reflected sound adding processing unit 204, and a sound image localizing processing unit 205, which are the same as those shown in FIG. 1, are provided with respect to a surround left input signal Surround Lin and a surround right input signal Surround Rin.

An adder AL2 adds a surround left signal obtained from the sound image localizing processing unit 205 to a front left signal obtained from the sound image localizing processing unit 105, and the result of the addition is outputted as a left output signal Lout.

An adder AR2 adds a surround right signal obtained from the sound image localizing processing unit 205 to a front right signal obtained from the sound image localizing processing unit 105, and the result of the addition is outputted as a right output signal Rout.

The invention claimed is:

1. A stereophonic device for headphones to which front signals for two or more channels and surround signals for two or more channels are inputted, comprising:

with respect to the inputted front signals and the inputted surround signals, an uncorrelating processing unit for reducing the correlation between the front signals and between the surround signals, a reflected sound adding processing unit for adding a reflected sound to each of the front signals and the surround signals, and a sound image localizing processing unit for controlling the position where a sound image is localized, based on the front signals and the surround signals, wherein the reflected sound adding processing unit used for the inputted front signals comprising front left and front right signals produces a reflected sound for the front left signal and a reflected sound for the front right signal based on a difference between the front left and front right signals inputted to the reflected sound adding processing unit, and adds the reflected sound produced for the front left signal to the front left signal and the reflected sound produced for the front right signal to the front right signal, and the reflected sound adding processing unit used for the inputted surround signals comprising surround left and surround right signals produces a reflected sound for the surround left signal and a reflected sound for the surround right signal based on a difference between the surround left and surround right signals inputted to the reflected sound adding processing unit, and adds the reflected sound produced for the surround left signal to the surround left signal and the reflected sound produced for the surround right signal to the surround right signal.

2. A computer readable storage medium including an audio signal processing program causing a computer to perform as a stereophonic device for headphones to which front signals for two or more channels and surround signals for two or more channels are inputted, the audio signal processing program comprising:

a program for causing the inputted front signals to be subjected to uncorrelating processing for reducing the correlation between the front signals, reflected sound adding processing for adding a reflected sound to each of the front signals, and sound image localizing processing for controlling the position where a sound image is localized based on the front signals; and a program for causing the inputted surround signals to be subjected to uncorrelating processing for reducing the correlation between the surround signals, reflected sound adding processing for adding a reflected sound to each of the surround signals, and sound image localizing processing for controlling the position where a sound image is localized based on the surround signals, wherein the reflected sound adding processing to be performed on the inputted front signals comprising front left and front right signals produces a reflected sound for the front left signal and a reflected sound for the front right signal based on a difference between the front left and front right signals to which the reflected sounds are to be added, and adds the reflected sound produced for the front left signal to the front left signal and the reflected sound produced for the front right signal to the front right signal, and the reflected sound adding processing to be performed on the inputted surround signals comprising surround left and surround right signals produces a reflected sound for the surround left signal and a reflected sound for the surround right signal based on a difference between the surround left and surround right signals to which the reflected sounds are to be added, and adds the reflected sound produced for the surround left signal to the surround left signal and the reflected sound produced for the surround right signal to the surround right signal.

* * * * *